US009734789B2

(12) United States Patent
Hu et al.

(10) Patent No.: US 9,734,789 B2
(45) Date of Patent: Aug. 15, 2017

(54) DISPLAY DEVICE HAVING A PIXEL STRUCTURE

(71) Applicant: Shenzhen China Star Optoelectronics Technology Co., Ltd., Shenzhen (CN)

(72) Inventors: Houliang Hu, Shenzhen (CN); Chih Hao Wu, Shenzhen (CN); Mingfeng Chen, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 0 days.

(21) Appl. No.: 14/892,196

(22) PCT Filed: Aug. 27, 2015

(86) PCT No.: PCT/CN2015/088263
§ 371 (c)(1),
(2) Date: Nov. 19, 2015

(87) PCT Pub. No.: WO2017/024624
PCT Pub. Date: Feb. 16, 2017

(65) Prior Publication Data

US 2017/0047042 A1 Feb. 16, 2017

(30) Foreign Application Priority Data

Aug. 13, 2015 (CN) ..... 2015 1 0495641

(51) Int. Cl.
*G09G 3/30* (2006.01)
*G09G 5/00* (2006.01)

(52) U.S. Cl.
CPC ..... *G09G 5/003* (2013.01); *G09G 2310/02* (2013.01)

(58) Field of Classification Search
CPC .. G09G 3/30; G09G 3/32; G09G 3/34; G09G 3/36; G09G 5/00; G06F 3/038
See application file for complete search history.

(56) References Cited

U.S. PATENT DOCUMENTS

2006/0061560 A1* 3/2006 Yamashita ..... G09G 3/3233 345/204
2008/0225026 A1* 9/2008 Uchino ..... G09G 3/3233 345/204
2010/0164844 A1* 7/2010 Lin ..... G09G 3/3233 345/55

(Continued)

FOREIGN PATENT DOCUMENTS

CN 1448910 10/2003
CN 101814268 8/2010
CN 102044213 5/2011

(Continued)

*Primary Examiner* — Pegeman Karimi

(57) ABSTRACT

The present invention discloses a display device, comprising a display panel, a data driving circuit, and a scan driving circuit, the data driving circuit being disposed on a side of the display panel in a first direction, the scan driving circuit being disposed on a side of the display panel in a second direction, the first direction being perpendicular to the second direction; both the data driving circuit and the scan driving circuit are connected to the display panel. The present invention can reduce a width of a non-display region of the display device under a premise of improving a display quality.

10 Claims, 3 Drawing Sheets

(56) References Cited

U.S. PATENT DOCUMENTS

| | | | | |
|---|---|---|---|---|
| 2012/0105501 | A1* | 5/2012 | Nakamura | G09G 3/3233 345/690 |
| 2015/0109280 | A1* | 4/2015 | Toyomura | G09G 3/3233 345/211 |

FOREIGN PATENT DOCUMENTS

| | | |
|---|---|---|
| CN | 102879968 | 1/2013 |
| CN | 203950533 | 11/2014 |
| JP | 2009-300752 | 12/2009 |
| KR | 10-2005-0049686 | 5/2005 |

* cited by examiner

DISPLAY DEVICE HAVING A PIXEL STRUCTURE

RELATED APPLICATIONS

This application is a National Phase of PCT Patent Application No. PCT/CN2015/088263 having International filing date of Aug. 27, 2015, which claims the benefit of priority of Chinese Patent Application No. 201510495641.3 filed on Aug. 13, 2015. The contents of the above applications are all incorporated by reference as if fully set forth herein in their entirety.

BACKGROUND OF THE INVENTION

1. Field of the Invention

The present invention relates to a field of display technology, and in particular to a display device.

2. Description of the Related Art

A traditional display device generally includes a scan driving circuit, a data driving circuit, and a display panel. The scan driving circuit and the data driving circuit are connected to the display panel.

After the scan driving circuit generates a scanning signal, the scanning signal is transmitted to the display panel, in order to turn on the gate electrode switch of the pixel unit in the display panel. At that moment, a data signal generated from the data driving circuit can pass through the gate electrode switch and be inputted into a pixel unit, in order to charge a gray-scale voltage into the pixel unit.

In the technical method above, a corresponding gray-scale signal formed by using a pulse width modulation (PWM) technology in the pixel unit is of 4 bits, and this is disadvantage for improving the display quality.

To increase the number of bits of the gray-scale signal, additional hardware costs are necessary for the display device. As a result, it is required to increase a width of an edge region (i.e. a non-display region) of the display device.

Therefore, an innovative technical method is required to solve the technical problems above.

SUMMARY OF THE INVENTION

The present invention aims to provide a display device which can reduce the width of the edge region (the non-display region) of the display device under a premise of improving a display quality.

To solve the problems above, the technical method of the present invention is the following:

a display device, wherein the display device comprises: a display panel; a data driving circuit, the data driving circuit disposed on a side of the display panel in a first direction, the data driving circuit being connected to the display panel; a scan driving circuit, the scan driving circuit disposed on a side of the display panel in a second direction, the scan driving circuit being connected to the display panel; the first direction being perpendicular to the second direction; the display panel comprising: at least two scan lines, the scan lines being used for transmitting scanning signals; at least two data lines, the data lines being used for transmitting data signals; at least two discharge lines, the discharge lines being used for transmitting discharging signals; and at least two pixel units, the pixel units connected to the scan lines, the data lines connected to the discharge lines, the pixel unit comprising: a pixel driving circuit, the pixel driving circuit being connected to the scan lines, the data lines and the discharge lines; and a display component, the pixel driving circuit and the display component are connected; the pixel driving circuit comprising: a first thin film transistor; a second thin film transistor; a third thin film transistor; and a storage capacitor; wherein the second thin film transistor is connected to the display component, and the second thin film transistor is also connected to the first thin film transistor and the third thin film transistor; a first wiring region is disposed between the scan driving circuit and the display panel, a second wiring region is disposed between the data driving circuit and the display panel; the scan line has a first extension line, the first extension line is disposed in the first wiring region, and the first extension line is connected to the scan driving circuit; the data line has a second extension line, the second extension line is disposed in the second wiring region, and the second extension line drive circuit is connected to the data driving circuit; the discharge line has a third extension line, the third extension line is disposed in the first wiring region, and the third extension line is connected to the scan driving circuit.

In the display device above, the first film transistor comprises a first gate electrode, a first source electrode, and a first drain electrode, the first gate electrode is connected to the scan line, and the first source electrode is connected to the data line; the second thin film transistor comprises a second gate electrode, a second source electrode, and a second drain electrode, the second gate electrode is connected to the first drain electrode, the second source electrode is connected to one of an anode and a cathode of the display component, and the second drain electrode is connected to the other one of the anode and the cathode; the third thin film transistor comprises a third gate electrode, a third source electrode, and a third drain electrode, the third gate electrode is connected to the discharge line, the third source electrode is connected to the second gate electrode, and the third drain electrode is connected to a discharge end; the storage capacitor comprises a first electrode plate and a second electrode plate, the first electrode plate is connected to the second source electrode, and the second electrode plate is connected to the second gate electrode.

In the display device above, the first gate electrode is used for receiving the scanning signal transmitted by the scan line, and the first gate electrode is used for opening or closing a first current channel between the first source electrode and the first drain electrode according to the scanning signal, the first source electrode is used for receiving the data signal transmitted by the data line; the second gate electrode is used for receiving the data signal provided by the first drain electrode, and the second gate electrode is used for opening or closing a second current channel between the second source electrode and the second drain electrode according to the data signal; the third gate electrode is used for receiving the discharging signal transmitted by the discharge line, and the third gate electrode is used for opening or closing a current channel between the third source electrode and the third drain electrode according to the discharging signal; the storage capacitor is used for receiving the data signal when the first current channel is opened, and storing an electric charge corresponding to the data signal, and used for discharging the stored electric charge when the third current channel is opened, and providing the discharged electric charge to the third source electrode.

In the display device above, the first extension line and the third extension line are staggered.

In the display device above, the first extension line is disposed between the two adjacent third extension lines, the third extension line is disposed between the two adjacent first extension lines.

In the display device above, the scan driving circuit comprises: a scanning signal generating module, the scanning signal generating module being used for generating the scanning signal; and a discharging signal generating module, the discharging signal generating module being used for generating the discharging signal; wherein the first extension line is connected to the scanning signal generating module, the third extension line is connected to the discharging signal generating module; the scanning signal generating module and the discharging signal generating module are integrated in the scan driving circuit.

In the display device above, the scan driving circuit comprises: a scanning signal generating circuit, the scanning signal generating circuit being used for generating the scanning signal; and a discharging signal generating circuit, the discharging signal generating circuit being used for generating the discharging signal; wherein the first extension line is connected to the scanning signal generating circuit, and the third extension line is connected to the discharging signal generating circuit.

A display device, the display device comprises: a display panel; a data driving circuit, the data driving circuit disposed on a side of the display panel on a first direction, and the data driving circuit being connected to the display panel; a scan driving circuit, the scan driving circuit disposed on a side of the display panel on a second direction, and the scan driving circuit being connected to the display panel; the first direction being perpendicular to the second direction.

In the display device above, the display panel comprises: at least two scan lines, the scan lines being used for transmitting scanning signals; at least two data lines, the data lines being used for transmitting data signals; at least two discharge lines, the discharge lines being used for transmitting discharging signals; and at least two pixel units, the pixel units being connected to the scan lines, and the data lines connected to the discharge lines, the pixel unit comprising: a pixel driving circuit, the pixel driving circuit being connected to the scan lines, the data lines and the discharge lines; and a display component, the pixel driving circuit and the display component are connected.

In the display device above, the pixel driving circuit comprises: a first thin film transistor; a second thin film transistor; a third thin film transistor; and a storage capacitor; wherein the second thin film transistor is connected to the display component, and the second thin film transistor is also connected to the first thin film transistor and the third thin film transistor.

In the display device above, the first film transistor comprises: a first gate electrode, a first source electrode, and a first drain electrode, the first gate electrode is connected to the scan line, and the first source electrode is connected to the data line; the first gate electrode is used for receiving the scanning signal transmitted by the scan line, the first gate electrode is used for opening or closing a first current channel between the first source electrode and the first drain electrode according to the scanning signal, and the first source electrode is used for receiving the data signal transmitted by the data line.

In the display device above, the second film transistor comprises a second gate electrode, a second source electrode, and a second drain electrode, the second gate electrode is connected to the first drain electrode, the second source electrode is connected to one of an anode and a cathode of the display component, the second drain electrode is connected to the other one of the anode and the cathode; the second gate electrode is used for receiving the data signal provided by the first drain electrode, the second gate electrode is used for opening or closing a second current channel between the second source electrode and the second drain electrode according to the data signal.

In the display device above, the third film transistor comprises a third gate electrode, a third source electrode, and a third drain electrode, the third gate electrode is connected to the discharge line, the third source electrode is connected to the second gate electrode, the third drain electrode is connected to a discharge end; the third gate electrode is used for receiving the discharging signal transmitted by the discharge line, the third gate electrode is used for opening or closing a current channel between the third source electrode and the third drain electrode according to the discharging signal.

In the display device above, the storage capacitor comprises: a first electrode plate and a second electrode plate, the first electrode plate is connected to the second source electrode, and the second electrode plate is connected to the second gate electrode; the storage capacitor is used for receiving the data signal when the first current channel is opened, for storing an electric charge corresponding to the data signal, and is used for discharging the stored electric charge when the third current channel is opened, and for providing the discharged electric charge to the third source electrode.

In the display device above, a first wiring region is disposed between the scan driving circuit and the display panel, and a second wiring region is disposed between the data driving circuit and the display panel.

In the display device above, the scan line has a first extension line, the first extension line is disposed in the first wiring region, and the first extension line is connected to the scan driving circuit; the data line has a second extension line, the second extension line is disposed in the second wiring region, and the second extension line drive circuit is connected to the data driving circuit; the discharge line has a third extension line, the third extension line is disposed in the first wiring region, and the third extension line is connected to the scan driving circuit.

In the display device above, the first extension line and the third extension line are staggered.

In the display device above, the first extension line is disposed between the two adjacent third extension lines, and the third extension line is disposed between the two adjacent first extension lines.

In the display device above, the scan driving circuit comprises: a scanning signal generating module, the scanning signal generating module being used for generating the scanning signal; and a discharging signal generating module, the discharging signal generating module being used for generating the discharging signal; wherein the first extension line is connected to the scanning signal generating module, and the third extension line is connected to the discharging signal generating module; the scanning signal generating module and the discharging signal generating module are integrated in the scan driving circuit.

In the display device above, the scan driving circuit comprises: a scanning signal generating circuit, the scanning signal generating circuit being used for generating the scanning signal; and a discharging signal generating circuit, the discharging signal generating circuit being used for generating the discharging signal; wherein the first extension line is connected to the scanning signal generating circuit, and the third extension line is connected to the discharging signal generating circuit.

Compared with the prior art, the present invention can reduce the width of the edge region (the non-display region) of the display device under a premise of improving a display quality.

BRIEF DESCRIPTION OF THE DRAWINGS

The accompanying drawings are included to provide a further understanding of the invention, and are incorporated into, and constitute a part of, this specification. The drawings illustrate embodiments of the invention and, together with the description, serve to explain the principles of the invention.

DESCRIPTION OF THE EMBODIMENTS

As used in this specification the term "embodiment" means an instance, an example, or an illustration. In addition, for the articles in this specification and the appended claims, "a" or "an" in general can be interpreted as "one or more" unless specified otherwise or clear from context to determine the singular form.

Figure 1:
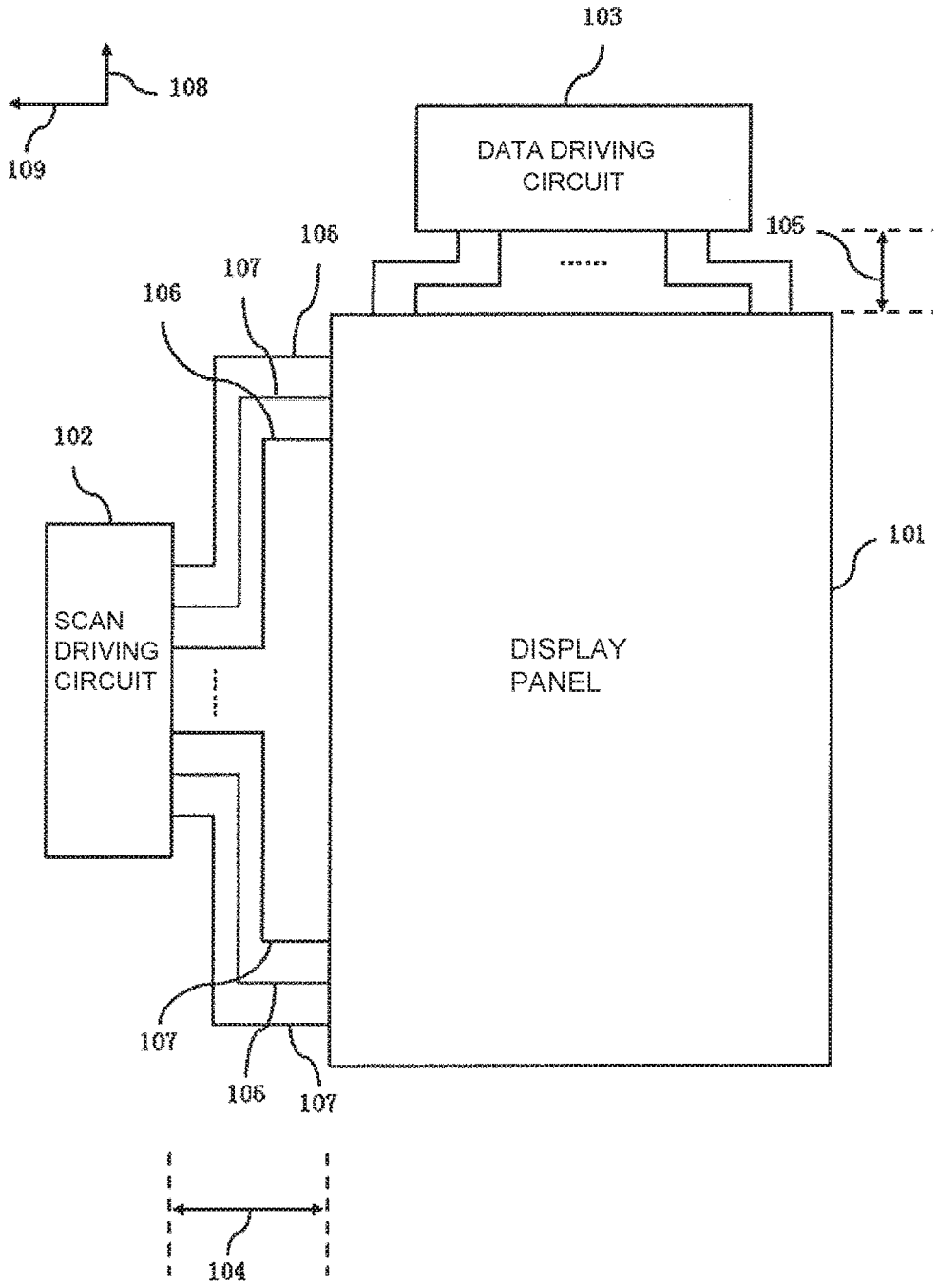
FIG. 1 illustrates the display device according to a first embodiment of the present invention.
Figure 3:
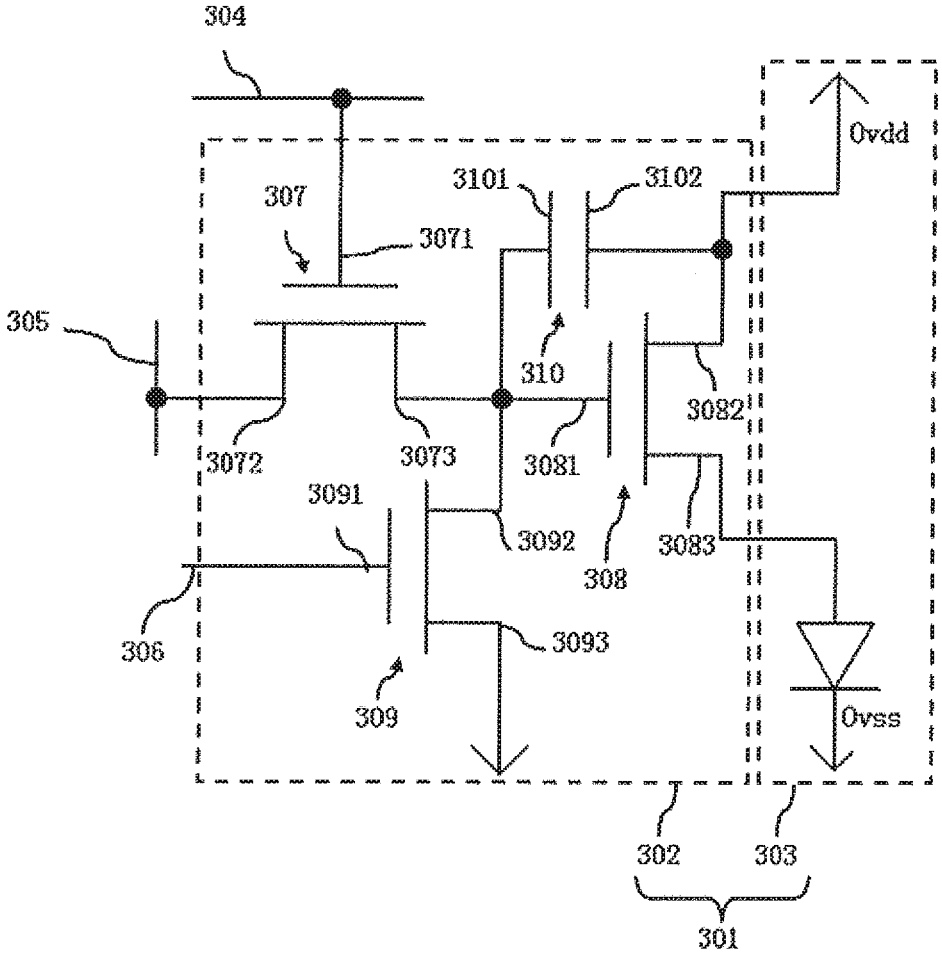
FIG. 3 illustrates a circuit diagram of the pixel unit of the display panels in FIG. 1 and FIG. 2.

Refer to FIG. 1 and FIG. 3. FIG. 1 illustrates the display device according to a first embodiment of the present invention, FIG. 3 illustrates a circuit diagram of the pixel unit 301 of the display panel 101 in FIG. 1.

The display device of the embodiment includes a display panel 101, a data driving circuit 103, and a scan driving circuit 102. The data driving circuit 103 is disposed on a side of the display panel 101 in a first direction 108, and the data driving circuit 103 is connected to the display panel 101. The scan driving circuit 102 is disposed on a side of the display panel 101 in a second direction 109, and the scan driving circuit 102 is connected to the display panel 101, wherein the first direction 108 is perpendicular to the second direction 109.

The display panel 101 may be a thin film transistor liquid crystal display (TFT-LCD), an organic light emitting diode (OLED), etc.

In the embodiment, the display panel 101 includes a scan line 304, a data line 305, a discharge line 306 and a pixel unit 301. The scan line 304 is used for transmitting a scanning signal. The data line 305 is used for transmitting a data signal. The discharge line 306 is used for transmitting a discharging signal. The pixel unit 301 and the scan line 304 are connected, and the data line 305 and the discharge line 306 are connected, wherein the pixel unit 301 includes a pixel driving circuit 302 and a display component 303.

The pixel driving circuit 302 is connected to the scan line 304, and the data line 305 is connected to the discharge line 306. The pixel driving circuit 302 is connected to the display component 303.

In the embodiment, the pixel driving circuit 302 includes a first thin film transistor 307, a second thin film transistor 308, a third thin film transistor 309, and a storage capacitor 310.

The second thin film transistor 308 is connected to the display component 303.

The second thin film transistor 308 is also connected to the first thin film transistor 307 and the third thin film transistor 309.

In the embodiment, and the first thin film transistor 307 includes a first gate electrode 3071, a first source electrode 3072, and a first drain electrode 3073.

The first gate electrode 3071 is connected to the scan line 304, and the first source electrode 3072 is connected to the data line 305.

The second thin film transistor 308 includes a second gate electrode 3081, a second source electrode 3082, and a second drain electrode 3083. The second gate electrode 3081 is connected to the first drain electrode 3073, and the second source electrode 3082 is connected to one of the anode and the cathode of the display component 303. The second drain electrode 3083 is connected to the other one of the anode and the cathode.

The third thin film transistor 309 includes a third gate electrode 3091, a third source electrode 3092, and a third drain electrode 3093, the third gate electrode 3091 is connected to the discharge line 306, the third source electrode 3092 is connected to the second gate electrode 3081, and the third drain electrode 3093 is connected to a discharge end.

The storage capacitor 310 includes a first electrode plate 3101 and a second electrode plate 3102, the first electrode plate 3101 is connected to the second source electrode 3082, and the second electrode plate 3102 is connected to the second gate electrode 3081.

In the embodiment, the first gate electrode 3071 is used for receiving the scanning signal transmitted by the scan line 304, the first gate electrode 3071 is used for opening or closing a first current channel between the first source electrode 3072 and the first drain electrode 3073 according to the scanning signal. The first source electrode 3072 is used for receiving the data signal transmitted by the data line 305.

The second gate electrode 3081 is used for receiving the data signal provided by the first drain electrode 3073, and the second gate electrode 3081 is used for opening or closing a second current channel between the second source electrode 3082 and the second drain electrode 3083 according to the data signal.

The third gate electrode 3091 is used for receiving the discharging signal transmitted by the discharge line 306, and the third gate electrode 3091 is used for opening or closing a current channel between the third source electrode 3092 and the third drain electrode 3093 according to the discharging signal.

The storage capacitor 310 is used for receiving the data signal when the first current channel is opened, storing an electric charge corresponding to the data signal, and is used for discharging the stored electric charge when the third current channel is opened, and for providing the discharged electric charge to the third source electrode 3092.

Through the technical method above, a number of bits of a gray-scale signal formed with pulse width modulation (PWM) technology is increased from 4 bits to 8 bits; this is good for improving the display quality.

In the embodiment, a first wiring region 104 is disposed between the scan driving circuit 102 and the display panel 101, and a second wiring region 105 is disposed between the data driving circuit 103 and the display panel 101.

The scan line 304 has a first extension line 106. The first extension line 106 is disposed in the first wiring region 104, and the first extension line 106 is connected to the scan driving circuit 102.

The data line 305 has a second extension line. The second extension line is disposed in the second wiring region 105, and the second extension line drive circuit is connected to the data driving circuit 103.

The discharge line 306 has a third extension line 107, the third extension line 107 is disposed in the first wiring region 104, and the third extension line 107 is connected to the scan driving circuit 102.

In the embodiment, the first extension line 106 and the third extension line 107 are staggered.

In the embodiment, the first extension line 106 is disposed between the two adjacent third extension lines 107, and the third extension line 107 is disposed between the two adjacent first extension lines 106.

In the embodiment, the scan driving circuit 102 includes a scanning signal generating module and a discharging signal generating module.

The scanning signal generating module is used for generating the scanning signal.

The discharging signal generating module is used for generating the discharging signal.

The first extension line 106 is connected to the scanning signal generating module, and the third extension line 107 is connected to the discharging signal generating module.

The scanning signal generating module and the discharging signal generating module are integrated in the scan driving circuit 102.

Through the technical method above, the present invention can reduce the width of the edge region (the non-display region) of the display device under a premise of improving a display quality.

Figure 2:
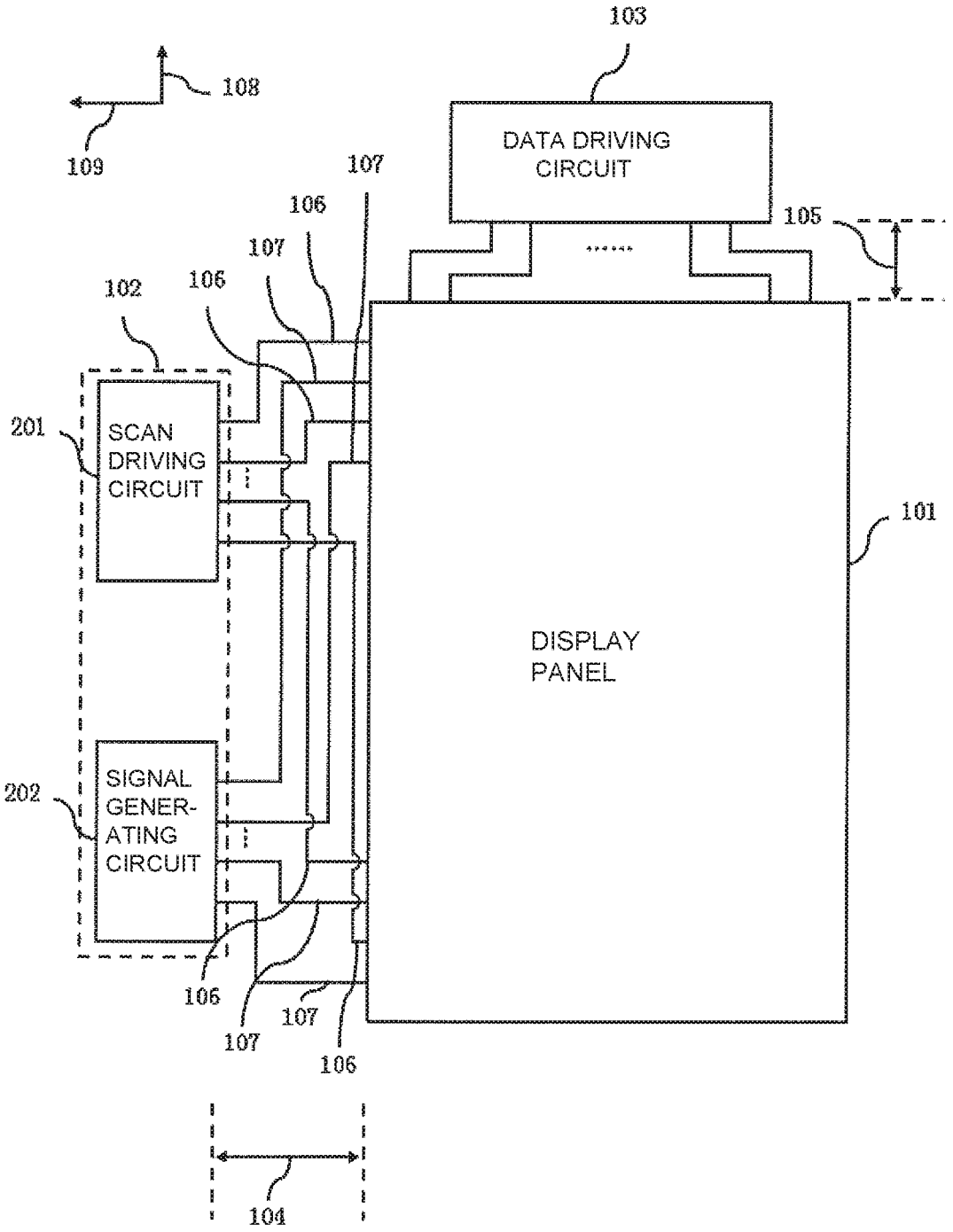
FIG. 2 illustrates the display device according to a second embodiment of the present invention.

Refer to FIG. 2, which illustrates the display device according to a second embodiment of the present invention. The embodiment is similar to the first embodiment above, the differences being:

In the embodiment, the scan driving circuit 102 includes a scanning signal generating circuit 201 and a discharging signal generating circuit 202.

The scanning signal generating circuit 201 is used for generating the scanning signal.

The discharging signal generating circuit 202 is used for generating the discharging signal.

The first extension line 106 is connected to the scanning signal generating circuit 201, and the third extension line 107 is connected to the discharging signal generating circuit 202.

In summary, although the present invention has been described in preferred embodiments above, the preferred embodiments described above are not intended to limit the invention. Persons skilled in the art can make various modifications to the present invention without departing from the scope of the invention as defined in the claims.

What is claimed is:

1. A display device, comprising:

a display panel;

a data driving circuit being disposed on a side of the display panel in a first direction, the data driving circuit being connected to the display panel;

a scan driving circuit being disposed on a side of the display panel in a second direction, the scan driving circuit being connected to the display panel;

wherein the first direction is perpendicular to the second direction;

wherein the display panel comprises:

at least two scan lines for transmitting scanning signals;

at least two data lines for transmitting data signals;

at least two discharge lines for transmitting discharging signals; and at least two pixel units connected to the scan lines, the data lines and the discharge lines, the pixel unit comprises:

a pixel driving circuit connected to the scan lines, the data lines, and the discharge lines; and a display component connected to the pixel driving circuit;

wherein the pixel driving circuit comprises:

a first thin film transistor;

a second thin film transistor;

a third thin film transistor; and a storage capacitor;

a common node;

wherein the second thin film transistor is connected to the display component, and the second thin film transistor is further connected to the first thin film transistor and the third thin film transistor;

wherein a first wiring region is disposed between the scan driving circuit and the display panel; and a second wiring region is disposed between the data driving circuit and the display panel;

wherein the scan line has a first extension line, the first extension line is disposed in the first wiring region, and the first extension line is connected to the scan driving circuit;

wherein the data line has a second extension line, the second extension line is disposed in the second wiring region, and a second extension line drive circuit is connected to the data driving circuit;

wherein the discharge line has a third extension line, the third extension line is disposed in the first wiring region, and the third extension line is connected to the scan driving circuit;

wherein a drain of the first thin film transistor, a source of the third thin film transistor, and a gate of the second thin film transistor are directly connected together via the common node;

wherein the storage capacitor is directly connected between the common node and a source of the second thin film transistor, a drain of the second thin film transistor being an input end of the display component; and wherein a source of the first thin film transistor is connected to the data line, a gate of third thin film transistor is connected to the discharge end, and a gate of the first thin film connected to a scan line.

2. The display device of claim 1, wherein the first extension line and the third extension line are staggered.

3. The display device of claim 2, wherein the first extension line is disposed between the two adjacent third extension lines, and the third extension line is disposed between the two adjacent first extension lines.

4. The display device of claim 1, wherein the scan driving circuit comprises:

a scanning signal generating module, the scanning signal generating module is used for generating the scanning signal; and a discharging signal generating module, the discharging signal generating module is used for generating the discharging signal;

wherein the first extension line is connected to the scanning signal generating module, and the third extension line is connected to the discharging signal generating module;

the scanning signal generating module and the discharging signal generating module are integrated in the scan driving circuit.

5. A display device, wherein the display device comprises:

a display panel;

a data driving circuit, the data driving circuit disposed on a side of the display panel in a first direction, the data driving circuit being connected to the display panel;

a scan driving circuit, the scan driving circuit disposed on a side of the display panel in a second direction, the scan driving circuit being connected to the display panel;

the first direction being perpendicular to the second direction;

wherein the display panel comprises:

at least two scan lines used for transmitting scanning signals;

at least two data lines used for transmitting data signals;

at least two discharge lines used for transmitting discharging signals; and at least two pixel units, the pixel units connected to the scan lines, and the data lines connected to the discharge lines, the pixel unit comprising:

a pixel driving circuit, the pixel driving circuit being connected to the scan lines, the data lines, and the discharge lines; and a display component, the pixel driving circuit and the display component being connected;

wherein the pixel driving circuit comprises a first thin film transistor, a second thin film transistor, a third thin film transistor, a storage capacitor, and a common node;

wherein the second thin film transistor is connected to the display component, and the second thin film transistor is also connected to the first thin film transistor and the third thin film transistor;

wherein a drain of the first thin film transistor, a source of the third thin film transistor, and a gate of the second thin film transistor are directly connected together via the common node;

wherein the storage capacitor is directly connected between the common node and a source of the second thin film transistor, a drain of the second thin film transistor being an input end of the display component; and wherein a source of the first thin film transistor is connected to the data line, a gate of the third thin film transistor is connected to the discharge end, and a gate of the first thin film connected to a scan line.

6. The display device of claim 5, wherein a first wiring region is disposed between the scan driving circuit and the display panel, and a second wiring region is disposed between the data driving circuit and the display panel.

7. The display device of claim 6, wherein the scan line has a first extension line, the first extension line is disposed in the first wiring region, and the first extension line is connected to the scan driving circuit;

the data line has a second extension line, the second extension line is disposed in the second wiring region, and a second extension line drive circuit is connected to the data driving circuit;

the discharge line has a third extension line, the third extension line is disposed in the first wiring region, and the third extension line is connected to the scan driving circuit.

8. The display device of claim 7, wherein the first extension line and the third extension line are staggered.

9. The display device of claim 8, wherein the first extension line is disposed between the two adjacent third extension lines, and the third extension line is disposed between the two adjacent first extension lines.

10. The display device of claim 6, wherein the scan driving circuit comprises:

a scanning signal generating module, the scanning signal generating module is used for generating the scanning signal; and a discharging signal generating module, the discharging signal generating module is used for generating the discharging signal;

wherein the first extension line is connected to the scanning signal generating module, and the third extension line is connected to the discharging signal generating module;

the scanning signal generating module and the discharging signal generating module are integrated in the scan driving circuit.

* * * * *